United States Patent [19]

Szigeti

[11] 4,427,130

[45] Jan. 24, 1984

[54] PILL DISPENSER INCORPORATED IN FINGER RING

[76] Inventor: Elemér Szigeti, 1 Place Eugène M̂., 06000 Nice (Alpes Maritimes), France

[21] Appl. No.: 304,477

[22] Filed: Sep. 22, 1981

[30] Foreign Application Priority Data

Oct. 2, 1980 [FR] France ..... 80 21140

[51] Int. Cl.[3] ..... B65D 83/04

[52] U.S. Cl. ..... 221/4; 63/1 R; 221/89; 221/185; 222/48

[58] Field of Search ..... 116/308; 222/78, 175, 222/25, 42, 48; 221/69, 89, 91, 185, 4; 63/1 R

[56] References Cited

U.S. PATENT DOCUMENTS

| | | | |
|---|---|---|---|
| 1,632,890 | 6/1927 | De Pamphilis | 222/175 X |
| 1,861,644 | 6/1932 | Roberts | 63/1 R |
| 2,235,350 | 3/1941 | Anderson | 222/175 X |
| 2,828,005 | 3/1958 | Ricke | 221/89 |
| 3,921,806 | 11/1975 | Wawracz | 116/308 X |
| 4,058,237 | 11/1977 | Luke | 222/175 X |
| 4,061,249 | 12/1977 | Smith | 222/78 |

*Primary Examiner*—David A. Scherbel

*Attorney, Agent, or Firm*—Karl W. Flocks; A. Fred Starobin; Sheridan Neimark

[57] ABSTRACT

A distributor, particularly for medicaments, to be worn directly on the body, which has an annular portion such as a finger ring or a wrist bracelet, on the outer surface of which is arranged at least one compartment provided with an opening device fast to a retractable member designed to project towards the inner surface of the annular portion in the open position of the compartment. The retractable member is in contact with the skin in the open position of the compartment and acts to warn of this open position.

6 Claims, 7 Drawing Figures

PILL DISPENSER INCORPORATED IN FINGER RING

BACKGROUND OF THE INVENTION

The present invention relates to an individual distributor for generally granulated products and, more particularly, for medicaments in a form administrable by the oral route, such as for example, tablets, pills and lozenges.

It is known that certain persons particularly those suffering from cardiac disorders are obliged, in the case of a crisis which can occur at any moment, to take a medicament with the minimum of delay, failing which there would be an aggravation in their condition and even, in certain cases, a fatal outcome.

These persons generally carry with them the appropriate medicament, but it may happen that they have none of it available, or with difficulty, at the desired time.

SUMMARY OF THE INVENTION

It is an object of the present invention therefore to overcome this situation, by providing an individual distributor which can be carried directly on the person, by day and by night, which is particularly simple in use whilst being of very low manufacturing cost, and enabling the user moveover, possibly in a weak state on account of his attack, to be warned if his distributor is in open or closed position.

According to another aspect of the invention, the above individual distributor may be associated with a watch, possibly with a sound alarm, so as to form a daily reserve of doses of medicament to be taken at certain intervals.

In accordance with the invention, the individual distributor comprises an annular part on the outer surface of which is arranged at least one reserve-compartment provided with an opening device, fast to a retractable member designed to project towards the inside of said annular part in open position of said compartment. The annular part is designed to be worn directly on the body and it is constituted by a ring for the finger or a bracelet. Thus the distributor is always immediately accessible to the patient, under any circumstances. In addition, the member which can project towards the inside of the annular part is supported directly on the finger or the wrist and thus warns the patient that the distributor is in open position, so that he knows that his medicament is available and, on the other hand, that he should not neglect to close the compartment again after use.

BRIEF DESCRIPTION OF THE DRAWINGS

Other features and advantages of the invention will emerge from the description which follows of several possible embodiments, considered in assocation with the accompanying drawings in which.

In these drawings, the same reference numerals denote the same elements.

DESCRIPTION OF THE PREFERRED EMBODIMENT

Figure 1:
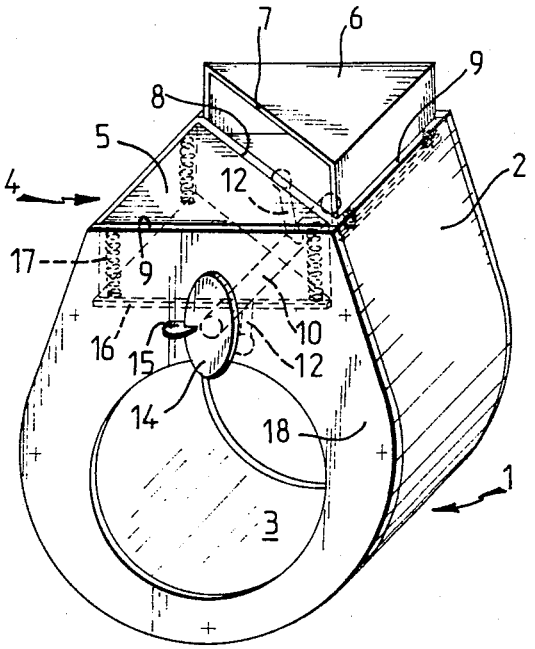
FIG. 1 shows a diagramatic perspective view of a two-compartment ring according to a first embodiment of the distributor according to the invention.
Figure 2:
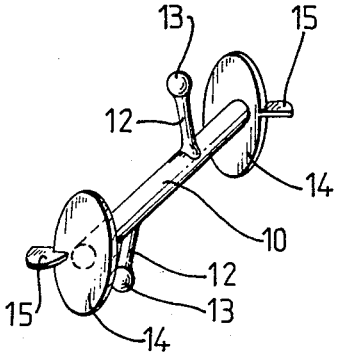
FIG. 2 shows a perspective view of the actuating shaft of the device for opening the compartments of the ring according to FIG. 1.
Figure 3:
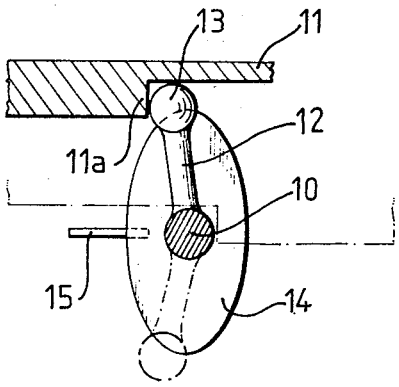
FIG. 3 shows a sectional view of the shaft according to FIG. 2, illustrating its operation.

Referring to FIGS. 1 to 3, an individual distributor comprises an annular part with the general reference 1, comprising an outer surface 2 and an inner surface 3.

This annular part 1 constitutes the ring of a ring for the finger, the whole of the distributor constituting substantially a signetring. On the outer face 2 is arranged a rectangular ornament or setting with the general reference 4 comprising two compartments 5 and 6 respectively, for example of prismatic shape, juxtaposed along an oblique face. The oblique face of each compartment 7 and 8 respectively, is open. There is also shown in FIG. 1 the compartment 6 in open position. In fact, each compartment is movable in the radial direction of the annular part 1, in guides 9, the open position corresponding to the position most remote from the centre of said annular part 1.

The opening device comprises a shaft 10 advantageously arranged parallel to the axis of the annular part 1 beneath the bottoms 11 of the compartments 5 and 6. The shaft 10 is provided with two stubs 12 with preferably spherical end 13 supported on the bottom 11 of the respective compartment. The two stubs are off-set angularly with respect to one another so as to act on one or other of the compartments, by rotation of shaft 10 which has the effect of pushing the selected compartment outwardly in its guides 9 on which it is advantageously mounted to slide relatively stiffly.

The shaft 10 is provided externally with a flat oval knurled wheel 14 arranged perpendicularly to its axis, itself fast to a suitable gripping means, for example an ear 15. Advantageously, bottom 11 comprises a discontinuity 11*a* forming a stop for the spherical head 13 in order to wedge the actuator in open position. The large axis of the oval mill wheel 14 is substantially parallel to the axis of the stub 12, so that the said wheel projects towards the inner face 3 of the annular part 1. Under these conditions, it is supported directly on the finger and warns the user of the open position, as explained above.

The bottoms of the compartments may if necessary include rims 16 limiting the outward travel against a stop formed in the upper part of the signet 4, small springs 17 being insertable between rim 16 and said stop. Under these conditions, and for ease of mounting, the ring may be constituted by the annular part on which are attached flanges 18.

Figure 4:
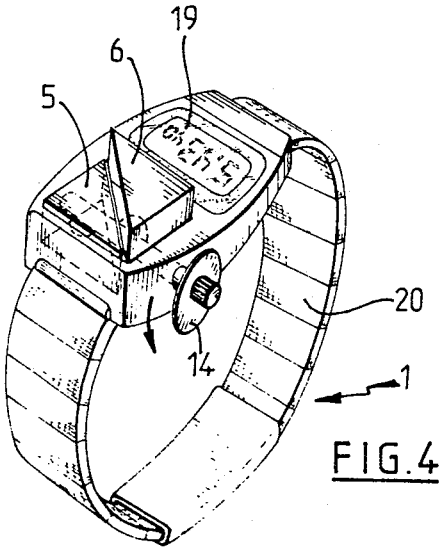
FIG. 4 shows a perspective view of a distributor according to the first embodiment, associated with a watch.

In FIG. 4 is seen a distributor according to the first embodiment described above, associated with a watch 19 whose bracelet 20 constitutes the annular part of general reference 1, the knurled wheel 14 being projectable towards the inner surface of said bracelet in open position.

Figure 5:
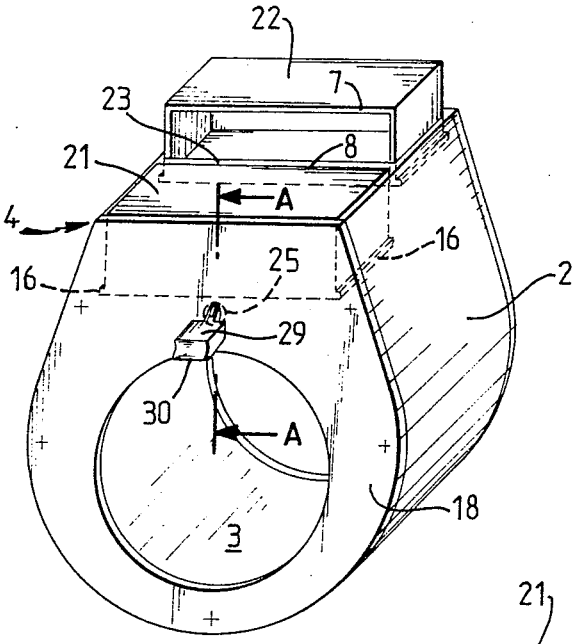
FIG. 5 shows a diagramatic view in perspective of a two-compartment ring according to a second embodiment of the distributor.
Figure 6:
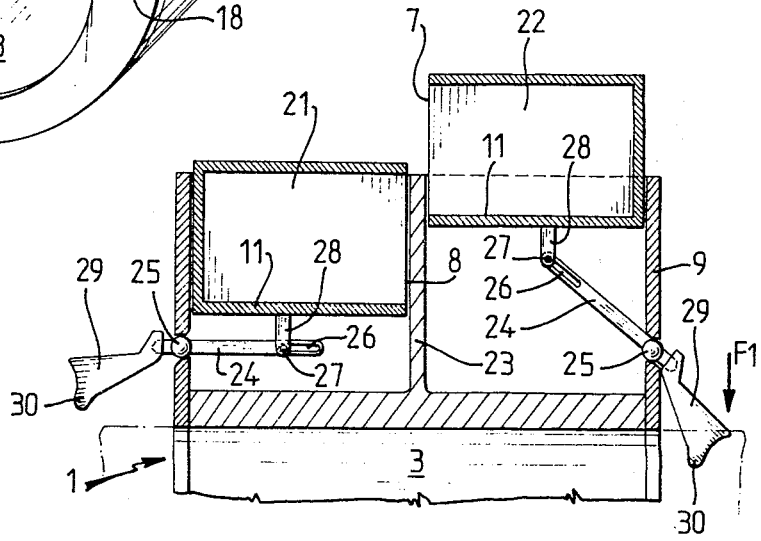
FIG. 6 shows a sectional view along the line A—A of FIG. 5.

Referring to FIGS. 5 and 6, according to a second embodiment, the movable compartments 21 and 22, provided possibly with rims 16, may be, for example, of parallelpipedic shape with an open face 7–8. The two compartments are inserted in the faces 9 of the setting, forming guides, and a partition 23 can besides separate them on the inside of the setting and also form a guide.

The opening device of this second embodiment comprises a lever 24 pivoting on one face of the setting, for example around a ball-joint 25. The end of the inner arm of the lever 24 includes slide 26 in which is inserted an axle 27 arranged in the vicinity of the bottom 11 on support 28, while the outer arm includes a tab 29. The downward movement of this tab 29 along the arrow F1 brings, on the one hand, the compartment 22 into open position and, on the other hand, a rounded part 30 of said tab to project towards the inner face 3 of the annular part 1, thereby playing the same role of warning as in the first embodiment described above.

Of course, this second embodiment can itself be associated with a watch, as in the case shown in FIG. 4.

Figure 7:
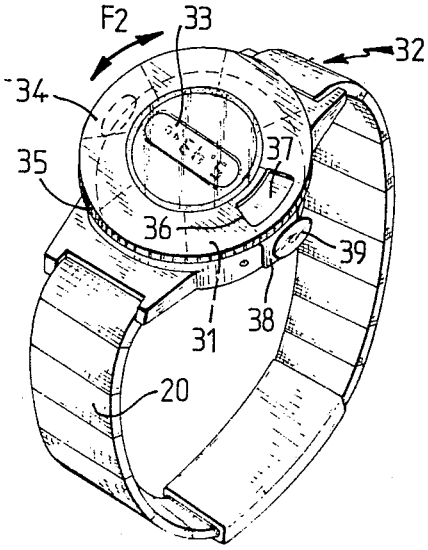
FIG. 7 shows diagramatically a perspective view of a distributor according to a third embodiment, associated with a watch.

Referring to FIG. 7, and according to a third embodiment, the annular part is, for example, a bracelet 20, but may also be a finger ring, on the outer surface of which is arranged a series of compartments 31 in the form of a crown with the general reference 32, which can include a watch 33 at its centre. This crown 32 is arranged in a plane substantially perpendicular to that of the annular part or of the bracelet 20 and it is provided on its upper part with a rotary cover 34 whose peripheral portion 35 is knurled. The covers includes an opening 36 which can come opposite each compartment, a solid portion 37 of the crown normally ensuring the closing when the opening 36 is facing this solid portion. A skirt 38 of the cover 34 is provided with at least one oval knurled wheel 39 in contact with the skin and designed to be arranged along its large axis perpendicular to the skin under the effect of rotation of the cover 34 along the double arrow F2 through the knurled portion 35, thus forming a retractable member for projecting towards the inside of the annular part in the open position of a compartment.

It is well understood that the present invention has only been described and illustrated by way of explanation which is in no way limiting and that any useful modification could be introduced therein, particularly within the field of technical equivalents, without departing from its scope.

What is claimed is:

1. Individual distributor for granulated products and particularly medicaments in a form administrable by the oral route, such as tablets, pills or lozenges, to be carried directly on the body as a finger ring as well as a wrist bracelet, said distributor comprising an annular portion having an inner surface and an outer surface, on the outer surface of which is arranged at least one compartment having an upper face and a bottom and movable in the radial direction of the annular portion between an upper open position and a lower closed position, associated with an opening device disposed under said bottom of said compartment, said opening device being fast with a means for warning the user of said distributor in the open position, including a part directed towards said inner surface of said annular portion in the open upper position of said compartment while the same is left through said opening device.

2. Distributor according to claim 1, comprising radial guides for compartments movable in the radial direction of the annular portion, each compartment including an open face adjacent to the bottom thereof, the open position of said compartment corresponding to the most remote position from the inner surface of said annular portion.

3. Distributor according to claim 1 wherein said device for opening a compartment includes a rotary shaft provided with a stub supported under the bottom of said radially movable compartment, a flat oval knurled wheel being arranged perpendicularly at the end of said shaft so that it forms said means having a part directed towards the inner surface of said annular portion in the open upper position of the compartment.

4. Distributor according to claim 1 wherein the device for opening a compartment includes a pivoting lever having an inner arm supported under the bottom of the compartment and an outer arm including a tab forming a retractable member for projecting towards the inner surface of said annular portion.

5. Distributor according to claim 1 wherein said annular portion is a wrist bracelet and is associated with a watch.

6. Distributor according to claim 1 wherein said annular portion forms a finger ring and constitutes substantially a signet ring.

* * * * *